US011685499B1

(12) United States Patent
Arbuckle et al.

(10) Patent No.: US 11,685,499 B1
(45) **Date of Patent: *Jun. 27, 2023**

(54) SYSTEMS AND METHODS FOR STEERING MARINE PROPULSION DEVICES

(71) Applicant: Brunswick Corporation, Mettawa, IL (US)

(72) Inventors: Jason S. Arbuckle, Horicon, WI (US); Thomas S. Kirchhoff, Waupaca, WI (US); Robert R. Osthelder, Omro, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/742,141

(22) Filed: May 11, 2022

Related U.S. Application Data

(63) Continuation of application No. 17/068,332, filed on Oct. 12, 2020, now Pat. No. 11,370,521.

(51) Int. Cl.
*B63H 25/42* (2006.01)
*B63H 25/02* (2006.01)
*B63H 20/00* (2006.01)

(52) U.S. Cl.
CPC ..... *B63H 25/42* (2013.01); *B63H 25/02* (2013.01); *B63H 2020/003* (2013.01); *B63H 2025/022* (2013.01); *B63H 2025/026* (2013.01)

(58) Field of Classification Search
CPC ... B63H 25/42; B63H 25/02; B63H 2020/003
See application file for complete search history.

(56) References Cited

U.S. PATENT DOCUMENTS 6,913,497 B1 * 7/2005 Ahiswede ..... B63H 20/12 440/63
7,467,595 B1 * 12/2008 Lanyi ..... B63H 25/02 114/144 R
8,046,122 B1 * 10/2011 Barta ..... F15B 11/08 701/41
8,113,892 B1 2/2012 Gable et al.
9,132,903 B1 * 9/2015 Gable ..... B63J 99/00
9,248,898 B1 * 2/2016 Kirchhoff ..... B63H 25/42
9,290,252 B1 * 3/2016 Tuchscherer ..... B63H 20/08
9,359,057 B1 * 6/2016 Andrasko ..... B63H 20/12
(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A steering system for marine propulsion devices having a steering device and steering actuators configured to change steering angles of the marine propulsion devices. A control system is operatively connected to the steering actuators and operatively connected to the steering device to receive steering requests from the steering device. The control system is configured to receive a request to activate the steering for a first device among the marine propulsion devices. The control system is further configured to change the steering angle of the first device according to a steering request when the steering request is received after receiving the request to activate the steering for the first device and to leave the steering angle for the first device unchanged when the steering request is received before receiving the request to activate the steering for the first device.

20 Claims, 6 Drawing Sheets

(56) References Cited

U.S. PATENT DOCUMENTS

| | | | | |
|---|---|---|---|---|
| 9,434,460 | B1 * | 9/2016 | Samples | B63H 20/12 |
| 9,733,645 | B1 * | 8/2017 | Andrasko | B63H 25/02 |
| 10,562,602 | B1 * | 2/2020 | Gable | B63H 25/42 |
| 10,800,502 | B1 | 10/2020 | Alby et al. | |

* cited by examiner

SYSTEMS AND METHODS FOR STEERING MARINE PROPULSION DEVICES

CROSS REFERENCE TO RELATED APPLICATION

This application is a continuation of U.S. patent application Ser. No. 17/068,332, filed Oct. 12, 2020, which is incorporated herein by reference in its entirety.

FIELD

The present disclosure generally relates to systems and methods for steering marine propulsion devices, and more particularly to systems and methods for aligning the steering angle of a marine propulsion device with that of other marine propulsion devices.

BACKGROUND

The following U.S. Patents and Patent Applications provide background information and are incorporated by reference in entirety.

U.S. Pat. No. 9,359,057 discloses a system for controlling movement of a plurality of drive units on a marine vessel having a control circuit communicatively connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit Steering angle.

U.S. Pat. No. 9,248,898 discloses a system that controls the speed of a marine vessel that includes first and second propulsion devices that produce first and second thrusts to propel the marine vessel. A control circuit controls orientation of the first and second propulsion devices about respective steering axes to control directions of the first and second thrusts. A first operator input device is moveable between a neutral position and a non-neutral detent position. When a second operator input device is actuated while the first operator input device is in the detent position, the control circuit does one or more of the following so as to control the speed of the marine vessel: varies a speed of a first engine of the first propulsion device and a speed of a second engine of the second propulsion device; and varies one or more alternative operating conditions of the first and second propulsion devices.

U.S. Pat. No. 9,132,903 discloses systems and methods for maneuvering a marine vessel having a plurality of steerable propulsion devices. The plurality of propulsion devices are controlled to achieve a lateral movement by controlling the steering orientation of port and starboard propulsion devices so that forward thrusts provided by the port and starboard propulsion devices intersect at or forwardly of a center of turn of the marine vessel. One of the port and starboard propulsion devices is operated to provide a forward thrust and the other of the port and starboard propulsion devices is operated to provide a reverse thrust so that the lateral movement is achieved and a resultant yaw component is applied on the marine vessel. An intermediate propulsion device is controlled to apply an opposing yaw component on the marine vessel that counteracts the resultant yaw component.

U.S. Pat. No. 7,467,595 discloses a method for controlling the movement of a marine vessel that rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 6,913,497 discloses a connection system for connecting two or more marine propulsion devices together provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

U.S. patent application Ser. No. 16/171,490 discloses a system for rotating an inner propeller shaft within a gearcase via a driveshaft. The system includes a stub shaft that extends between forward and aft ends and is rotatable within the gearcase. A forward gear is rotatably coupled to the stub shaft, where the forward gear meshes with the driveshaft and is engageable to become rotatably fixed to the stub shaft such that rotating the driveshaft rotates the stub shaft. A shock absorbing coupler is positioned within the gearcase, where the coupler has forward and aft ends, where the forward end of the coupler is engageable with the aft end of the stub shaft, and where the aft end of the coupler engageable with the inner propeller shaft. The coupler is torsional between the forward and aft ends such that shock is absorbable between the inner propeller shaft and the driveshaft.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for aligning steering angles of marine propulsion devices. The method includes receiving a first steering request from a steering device to steer the marine propulsion devices, where when the first steering request is received, steering for a first device among the marine propulsion devices is deactivated and steering for a second device is activated. The method further includes changing a steering angle of the second device according to the first steering request while leaving a steering angle of the first device unchanged. The method further includes receiving a request to activate steering for the first device and receiving a second steering request from the steering device to steer the marine propulsion devices. The method further includes changing the steering angles of both the first device and the second device according to the second steering request when the second steering request is received after receiving the request to activate steering for the first device, and changing the steering angle of the second device according to the second steering request while leaving the steering angle for the first device unchanged when the second steering request is received before receiving the request to activate steering for the first device.

Another embodiment generally relates to a method for aligning steering angles of marine propulsion devices. The method includes receiving a request to activate steering for a first device among the marine propulsion devices in which steering was previously deactivated, and receiving a steering request from a steering device to steer the marine propulsion devices. The method further includes steering a second device among the marine propulsion devices according to the steering request received from the steering device. The method further includes comparing a steering angle of the first device to a steering angle of the second device to determine a delta therebetween, then comparing the delta determined between the steering angles of the first and second devices to a threshold range. The method further includes changing the steering angle of the first device according to the steering request from the steering device when the delta between the steering angles of the first device and the second device is determined to be less than or equal to the threshold range, and leaving the steering angle of the first device unchanged when the delta between the steering angles of the first device and the second device is determined to exceed the threshold range.

Another embodiment generally relates to a steering system for marine propulsion devices. The system includes a steering device and steering actuators configured to change steering angles of the marine propulsion devices. A control system is operatively connected to the steering actuators and operatively connected to the steering device to receive steering requests therefrom. The control system is configured to receive a first steering request while steering for a first device among the marine propulsion devices is deactivated, and to control the steering actuation systems to steer a second device among the marine propulsion devices in which steering is activated according to the first steering request while leaving a steering angle of the first device unchanged. The control system is further configured to receive a second steering request after steering for the first device has been activated, compare the steering angle of the first device to a steering angle of the second device, and to control the steering actuators to steer both the first device and the second device according to the second steering request only when the steering angle of the first device is within a threshold range of the steering angle of the second device.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
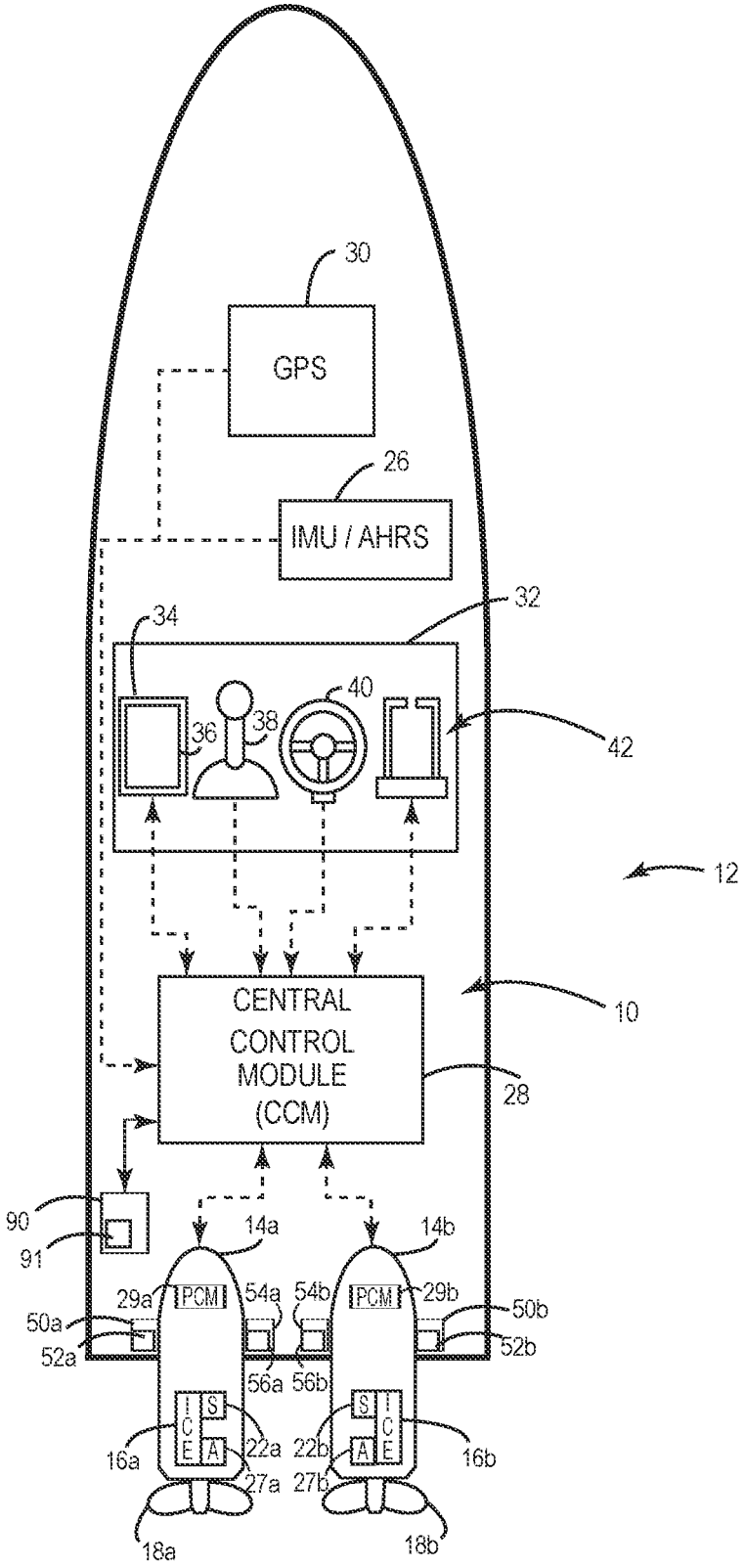
FIG. 1 is a top view of an exemplary marine vessel incorporating the systems and methods of the present disclosure.
Figure 5:
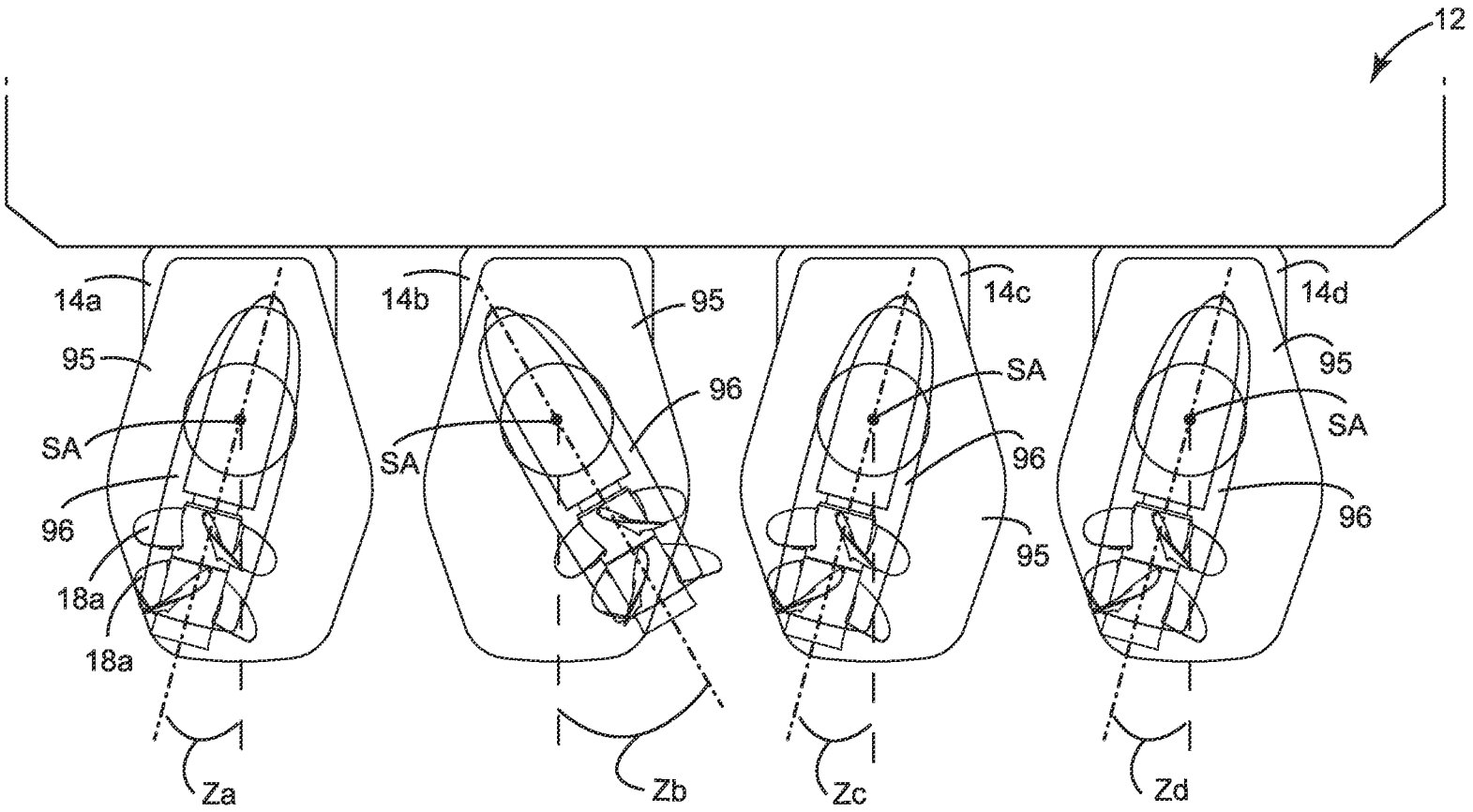
FIG. 5 is a top view of a configuration similar to that of FIG. 4, but with the four marine propulsion devices shown as having steerable lower gear cases.

FIG. 1 illustrates a steering system 10 for steering a plurality of propulsion devices 14*a* and 14*b*, and for aligning the steering angles of marine propulsion devices 14*a*, 14*b* on a marine vessel 12. The marine propulsion devices 14*a*, 14*b* shown are outboard motors; however, the marine propulsion devices could instead be inboard motors, stern drives, pod drives, outboard motors having steerable gearcases (as shown in FIG. 5, for example) and/or jet drives, for example. Each marine propulsion device 14*a*, 14*b* includes an powerhead 16*a* or 16*b*. The powerheads 16*a*, 16*b* shown here may be internal combustion engines, for example, gasoline or diesel engines, electric motors, and/or a hybrid thereof. Each marine propulsion device 14*a*, 14*b* in the present example also includes a propeller 18*a* or 18*b* configured to be coupled in torque-transmitting relationship with a respective powerhead 16*a* or 16*b*.

The marine propulsion devices 14*a*, 14*b* further include powerheadspeed sensors 22*a*, 22*b* measuring a speed of a respective powerhead 16*a*, 16*b* (or an output shaft thereof). In one example, the powerheadspeed sensors 22*a*, 22*b* may be shaft rotational speed sensors (e.g., Hall-Effect sensors), which measure a speed of the powerhead 16*a* or 16*b* in rotations per minute (RPM), as is known to those having ordinary skill in the art.

A central control module 28 (or CCM) is provided in signal communication with the powerheads 16*a*, 16*b*, as well as being in signal communication with the associated sensors and other components noted herein below. In certain examples, the central control module 28 communicates with propulsion control modules 29*a*, 29*b* (or PCMs) and/or other control devices associated with each of the marine propulsion devices 14*a*, 14*b* in a manner known in the art.

Power is provided to the marine vessel 12 via a power system 90, which in certain embodiments includes batteries 91 and/or other energy storage systems known in the art. The power system 90 provides power to the central control module 28 and propulsion control modules 29*a*, 29*b*, as well as to other components associated with the marine propulsion devices 14*a*, 14*b* or marine vessel 12 more generally. Among the other components powered by the power system 90 is the steering system 10, which includes steering actuators 50*a*, 50*b* that steer the marine propulsion devices 14*a*, 14*b*, respectively, in accordance with commands from a steering device as discussed further below. Exemplary steering actuators 50*a*, 50*b* are disclosed in U.S. Pat. Nos. 7,150,664; 7,255,616; and 7,467,595, which are incorporated by reference herein. In certain examples, the steering actuators 50*a*, 50*b* are hydraulic steering actuators operating according to the principles described in the patents cited above. Other examples of steering actuators 50*a*, 50*b* include electric motors and pneumatic actuators.

One mechanism by which power is supplied to the power system 90 is via alternators 27*a*, 27*b* associated with the marine propulsion devices 14*a*, 14*b*, respectively, in a manner known in the art. The power supplied to the power system 90 then aids in powering any power consuming devices connected thereto, as well as being used to charge the batteries 91. It will be recognized that the power may also be supplied from the marine propulsion devices 14*a*, 14*b* to the power system 90 via other charging devices, such as a stator associated with each marine propulsion device 14*a*, 14*b*, for example. In this manner, the alternators 27*a*, 27*b* may provide at least some of the power required for steering the marine propulsion devices 14*a*, 14*b* via the corresponding steering actuators 50*a*, 50*b* while that marine propulsion device 14*a*, 14*b* is running.

Figure 2:
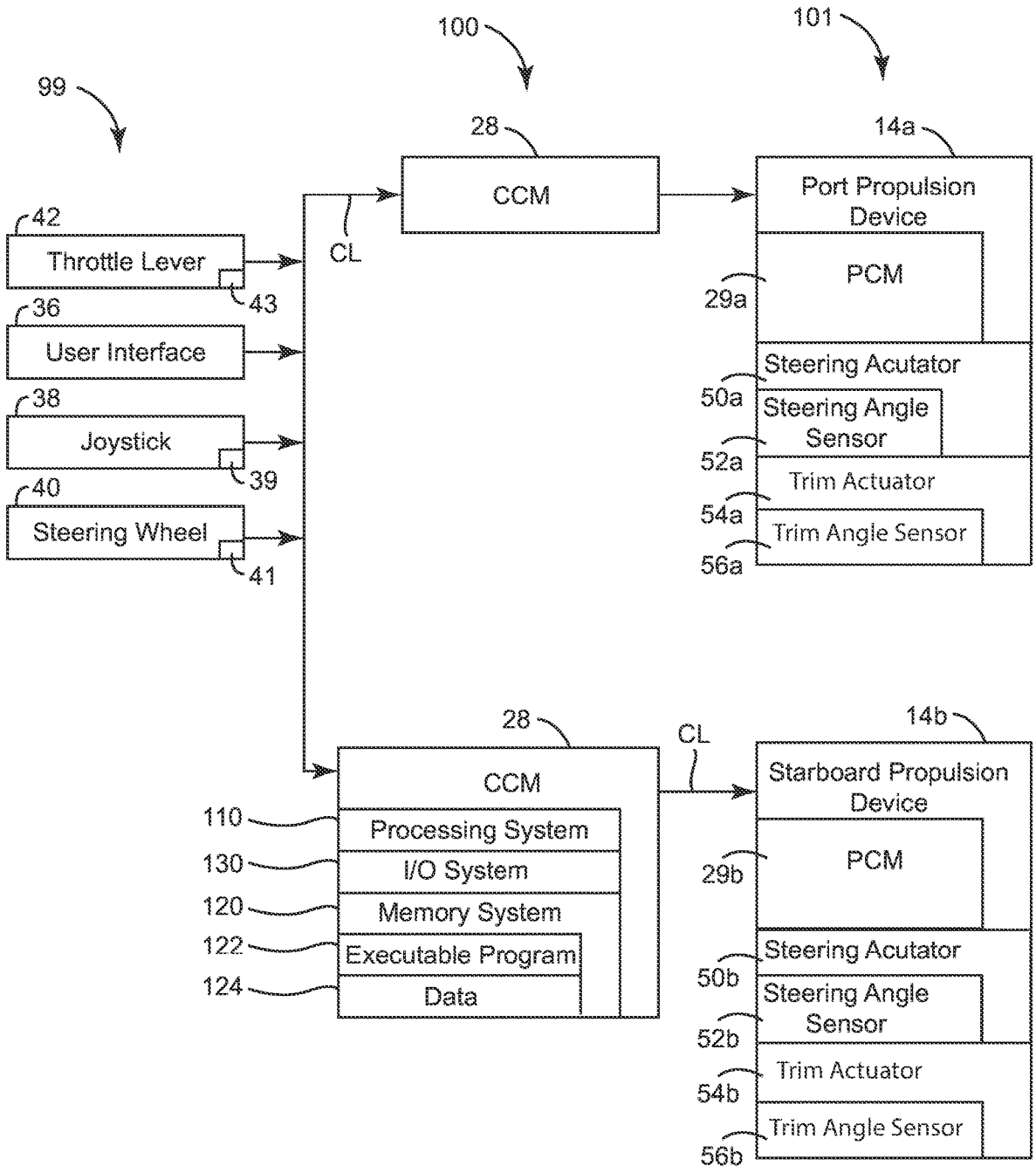
FIG. 2 is schematic view of a control system such as may be incorporated within the marine vessel of FIG. 1.

Subject to improvements discussed below, the central control module 28 and/or propulsion control modules 29 control steering for the marine propulsion devices 14*a*, 14*b* through control of the steering actuators 50*a*, 50*b* in a manner known in the art. In the example shown in FIG. 1, these steering actuators 50*a*, 50*b* are "steer-by-wire" systems, whereby the steering actuators 50*a*, 50*b* are controlled by electronic signals from the central control module 28 and/or propulsion control modules 29*a*, 29*b* rather than by physical linkages to such steering devices, such as a steering wheel 40. As shown in FIG. 2 and discussed further below, sensors 39, 41 associated with the steering devices detect the positions of these steering devices and provide electronic signals to the central control module 28 for subsequently steering the marine vessel 12 in a manner known in the art. Steering angle sensors 52*a*, 52*b* are also provided in conjunction with each steering actuator 50*a*, 50*b* to provide feedback regarding the steering angle of each marine propulsion device 14*a*, 14*b* at any given time, also in a manner known in the art.

It will be recognized that the actual steering angle of each marine propulsion device 14*a*, 14*b* may be inferred based on the position of the steering actuators 50*a*, 50*b*, for example whereby the steering angle sensors 52*a*, 52*b* are encoders associated with the steering actuators 50*a*, 50*b*. In the embodiment shown in FIG. 1, each marine propulsion device 14*a*, 14*b* is independently steerable via the corresponding steering actuators 50*a*, 50*b* with no connection to marine propulsion devices, for example connections via tie-bars.

The central control module 28 and/or propulsion control modules 29*a*, 29*b* also communicates with a trim actuator 54*a*, 54*b* associated with of the marine propulsion devices 14*a*, 14*b* to adjust the trim angle of these devices in a manner known in the art. Feedback regarding the trim angle of the marine propulsion devices 14*a*, 14*b* are also provided via trim angle sensors 56*a*, 56*b* in a manner known in the art. Each marine propulsion device 14*a*, 14*b* is independently adjustable with respect to trim angle in a similar manner to being independently steerable. Additional information regarding exemplary trim actuators 54*a*, 54*b* and trim angle sensors 56*a*, 56*b* is provided in U.S. Pat. Nos. 6,583,728; 7,156,709; 7,416,456; and 9,359,057, which are incorporated by reference herein.

Additional information is now provided for subsystems within an exemplary central control module 28, as shown in FIG. 2. A person of ordinary skill in the art will recognize that these subsystems may also be present within additional central control modules 28 (as applicable), and/or propulsion control modules 29*a*, 29*b* or other controllers within the marine vessel 12. In the example shown, the central control module 28 includes a processing system 110, which may be implemented as a single microprocessor or other circuitry, or be distributed across multiple processing devices or subsystems that cooperate to execute the executable program 122 from the memory system 120. Non-limiting examples of the processing system include general purpose central processing units, application specific processors, and logic devices. In the example shown, two central control modules 28, each associated with a marine propulsion device 14*a*, 14*b*, together comprise a control system 100. However, as discussed above, the propulsion control modules 29*a*, 29*b* and/or other controllers in alternate configurations may also be considered to be part of the control system 100.

The central control module 28 further includes a memory system 120, which may comprise any storage media readable by the processing system 110 and capable of storing the executable program 122 and/or data 124. The memory system 120 may be implemented as a single storage device, or be distributed across multiple storage devices or subsystems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. An input/output (I/O) system 130 provides communication between the control system 100 and peripheral devices, such as input devices 99 and output devices 101, which are discussed further below. In practice, the processing system 110 loads and executes an executable program 122 from the memory system 120, accesses data 124 stored within the memory system 120, and directs the steering system 10 to operate as described in further detail below.

A person of ordinary skill in the art will recognize that these subsystems within the control system 100 may be implemented in hardware and/or software that carries out a programmed set of instructions. As used herein, the term "central control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. As shown in FIG. 2, one or more central control module 28 may together constitute a control system 100. The one or more central control modules 28 can be located anywhere on the marine vessel 12.

A person of ordinary skill in the art will understand in light of the disclosure that the control system 100 may include a differing set of one or more control modules, or control devices, which may include engine control modules (ECMs) for each marine propulsion device 14*a*, 14*b* (which will be referred to as ECMs even if the marine propulsion device 14*a*, 14*b* contains an electric motor in addition to or in place of an internal combustion engine), one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 100 communicates with each of the one or more components of the marine vessel 12 via a communication link CL, which can be any wired or wireless link. The illustrated communication link CL connections between functional and logical block components are merely exemplary, which may be direct or indirect, and may follow alternate pathways. The control system 100 is capable of receiving information and/or controlling one or more operational characteristics of the marine vessel 12 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the marine vessel 12. Moreover, the communication link CL lines are meant only to demonstrate that the various control elements are capable of communicating with one another, and do not represent actual wiring connections between the various elements, nor do they represent the only paths of communication between the elements. Additionally, the marine vessel 12 may incorporate various types of communication devices and systems, and thus the illustrated communication links CL may in fact represent various different types of wireless and/or wired data communication systems.

As will be discussed further below, the control system 100 communicates with input devices 99 from various components such as steering devices, for example via sensors 39, 41 that detect the positions of a joystick 38, steering wheel 40, respectively. The control system 100 also communicates with other operator input devices, such as the throttle lever 42 via its sensor 43, or a user interface 36, for example by setting a route or destination using the GPS 30 or other systems discussed below. The control system 100 also communicates with output devices 101 such as propulsion control modules 29*a*, 29*b*, steering actuators 50*a*, 50*b*, and trim actuators 54*a*, 54*b*, for example. It will be recognized that the arrows shown are merely exemplary and that communication may flow in multiple directions. For example, the steering angle sensors 52*a*, 52*b* and trim angle sensors 56*a*, 56*b*, while shown as corresponding to the steering actuators 50*a*, 50*b* and trim actuators 54*a*, 54*b*, may serve as input devices 99 feeding into the one or more central command modules 28.

Although FIG. 1 shows one central control module 28, it will be recognized that more than one central control module may work together serially and/or in parallel, such as one central control module for each of the plurality of propulsion devices 14*a*, 14*b* as shown in FIG. 2. Portions of the method disclosed herein below can be carried out by a single central control module or by several separate control modules communicatively connected and cooperating to provide steering and propulsion control for the marine vessel 12, such as based on user input at a steering device 38, 40 at the helm 32. For example, the one or more central control module 28 may be communicatively connected to a propulsion control module 29*a*, 29*b* associated with each of the marine propulsion devices 14*a*, 14*b*. If more than one central control module is provided, each can control operation of a specific device or sub-system on the marine vessel.

Returning to FIG. 1, the marine vessel 12 also includes a global positioning system (GPS) 30 that provides location and speed of the marine vessel 12 to the central control module 28. Additionally or alternatively, a vessel speed sensor such as a Pitot tube or a paddle wheel could be provided. The marine vessel 12 may also include an inertial measurement unit (IMU) or an attitude and heading reference system (AHRS) 26. An IMU has a solid state, rate gyro electronic compass that indicates the vessel heading and solid state accelerometers and angular rate sensors that sense the vessel's attitude and rate of turn. An AHRS provides 3D orientation of the marine vessel 12 by integrating gyroscopic measurements, accelerometer data, and magnetometer data. The IMU/AHRS could be GPS-enabled, in which case a separate GPS 30 would not be required.

As discussed above, the marine vessel 12 includes a number of operator input devices located at the helm 32 of the marine vessel 12. The operator input devices include a multi-functional display device 34 including a user interface 36. The user interface 36 may be an interactive, touch-capable display screen, a keypad, a display screen and keypad combination, a track ball and display screen combination, or any other type of user interface known to those having ordinary skill in the art for communicating with a multi-functional display device 34. The operator input devices further includes one or more steering devices, such as a steering wheel 40 and/or a joystick 38, configured to facilitate user input to control the steering system 10, and thus to steer the vessel 12. In the embodiment shown, a joystick 38 provided at the helm 32 allows an operator of the marine vessel 12 to command the marine vessel 12 to translate or rotate in any number of directions. A steering wheel 40 is provided for providing steering commands to the marine propulsion devices 14*a*, 14*b*. A throttle lever 42 is also provided for providing thrust commands, including both a magnitude and a direction of thrust, to the central control module 28. Here, two throttle levers are shown, each of which can be used to control one of the marine propulsion devices 14*a* or 14*b*, although the two levers can be controlled together as a single lever. Alternatively, a single lever could be provided for controlling both marine propulsion devices 14*a*, 14*b*.

Several of the operator input devices at the helm 32 can be used to input an operator command for the powerheads 16*a*, 16*b* to the central control module 28, including the user interface 36 of the multi-functional display device 34, the joystick 38, and the throttle lever 42. By way of example, a rotation of the throttle lever 42 in a forward direction away from its neutral, detent position could be interpreted as a value from 0% to 100% operator demand corresponding via an input/output map, such as a look up table, to a position of the throttle valves of the powerheads 16*a*, 16*b*. For example, the input/output map might dictate that the throttle valves are fully closed when the throttle lever 42 is in the forward, detent position (i.e., 0% demand), and are fully open when the throttle lever 42 is pushed forward to its furthest extent (i.e., 100% demand). As discussed further below, similar methods may also be employed for controlling steering, whereby operator inputs are received from a range of −100% to +100% corresponding to full port and full starboard steering directions, which then cause corresponding steering of the marine propulsion devices 14*a*, 14*b*, in certain examples through the use of a lookup table.

Through experimentation and development, the present inventors have recognized problems relating to steering multiple marine propulsion devices that are not connected via tie-bars or other physical linkages, and specifically problems with respect to aligning steering angles when the steering for one marine propulsion device has previously been deactivated. As will be discussed below, steering for a marine propulsion device is "deactivated" any time the steering system 10 is not causing a steering angle thereof to change, despite receiving user inputs to steer the marine vessel 12.

In a typical marine propulsion device, the steering actuators 50*a*, 50*b* (FIG. 1) consume a substantial amount of energy during operation to steer the corresponding marine propulsion devices 14*a*, 14*b*. As discussed above, the alternators 27*a*, 27*b* may provide at least some of the power required for steering the marine propulsion devices 14*a*, 14*b* while the corresponding marine propulsion device 14*a*, 14*b* is running. However, when a given marine propulsion device is not operating, meaning power is not being generated by the corresponding alternator, the steering systems for any such non-operating marine propulsion device are customarily deactivated so as to not deplete the stored energy within the power system 90. In other words, deactivated steering actuators 50*a*, 50*b* are not presently steerable, despite continue to receive user inputs to steer, for example. While no longer steerable, the marine propulsion devices with which steering has been disabled still have an impact on overall steering, specifically as static rudders.

In contrast, steering systems for marine propulsion devices that are presently capable of steering may be referred to as "activated." It will be recognized that steering systems may thus be deactivated for multiple reasons, including the corresponding marine propulsion devices being "key-off", hardware faults that do not permit steering, and/or software or networking faults that do not permit steering, for example. The steering systems for the marine propulsion device can thus be activated or reactivated by turning the corresponding marine propulsion device's key to the on position, and/or resolving the faults described in the previous example. As such, the occurrence of one of the aforementioned actions thereby serve as a request to the central control module 28 to activate steering for the marine propulsion device in which steering was previously deactivated.

The inventors have recognized that systems in which marine propulsion devices are not physically connected with tie bars and/or the like are becoming more prevalent, as is the number of marine propulsion devices being installed on marine vessels. Moreover, as the number of marine propulsion devices being installed on marine vessels increases, the circumstances in which an operator may not require the use or operation of all marine propulsion devices increases, for example where performance demands do not require the cost of operating all marine propulsion devices.

In view of this, alternative measures are necessary for controlling the steering angles of marine propulsion devices such that collisions between adjacent propulsion devices do not occur when one or more of the marine propulsion devices become deactivated (for example, collisions between the corresponding propellers of adjacent propulsion devices). Limitations to the steering angles for steerable marine propulsion devices may be incorporated into the software in a control system, for example, such as through reference of a lookup table or algorithm. As discussed further below, the marine propulsion devices may be deactivated from a steering perspective due to being keyed off, and/or deactivated due to some fault condition (e.g., electrical, mechanical or both).

The degree to which a non-steering marine propulsion device impacts the steering of the other, operable or steerable marine propulsion devices may depend in part upon the steering angle of the non-steerable marine propulsion device when it becomes disabled. For example, a marine propulsion device that becomes disabled with a steering angle corresponding to driving the marine vessel dead ahead (a zero degree steering angle) may be less limiting on adjacent marine propulsion devices than if the non-steerable marine propulsion device were disabled when steering at a 30 degree steering angle, for example. It will be recognized that these limitations on the movement of the remaining marine propulsion devices may thus yield lesser steering angles than are being commanded by the operator. Other factors also include the separation distance between the marine propulsion devices, which the present inventors have recognized is also decreasing as the number of marine propulsion devices being mounted on marine vessels increases. Additional consideration may also be made for deflection of the marine propulsion device under load, such as when the marine propulsion device is coupled to the marine vessel using soft durometer mounts, for example. Limitations may also take into account the present trim levels of marine propulsion devices, and/or whether each marine propulsion devices has one versus two propellers, for example. Specifically, a dual propeller configuration may extend the overall length of the marine propulsion being steered, thereby increasing the possibility of colliding with adjacent marine propulsion devices over single propeller configurations.

Moreover, through experimentation and development, the present inventors have identified further problems with simply allowing a previously deactivated marine propulsion device to steer again once that marine propulsion device becomes activated (e.g., immediately snapping in alignment with the other marine propulsion devices). For example, if a previously deactivated marine propulsion device suddenly started to steer, for example upon being started up, this would result in a steering change to the marine vessel without the operator changing the steering device. Likewise, as the previously unsteerable marine propulsion device moves out of the way, the remaining marine propulsion devices could then steer to new limits (or not be limited at all), again without the operator changing the position of the steering wheel. This unintended change in steering direction for the marine vessel may be confusing or irritating to the operator, if not dangerous for the marine vessel or objects nearby if accidental collision occurs.

In certain systems presently known in the art, the steering wheel 40 or other steering device (e.g., the joystick 38 of FIG. 1) transmits a steering percentage to the central control module 28 to steer the marine propulsion devices 14*a*, 14*b* based on the location of the steering device relative to its centered position. The steering percentage may be detected by a sensor 39 associated with the joystick 38 in a manner known in the art, for example (see FIG. 2). Accordingly, this value transmitted from the steering device 36, 38, 40, 42 can be defined as being between −100 percent and +100 percent corresponding the steering all the way to port, and all the way to starboard, respectively. The central control module 28 then translates this input to changes in the steering angles of the marine propulsion devices within some predefined limit, for example between −45 and +45 degrees relative to dead ahead (depending, among other things, on the distance of separation between marine propulsion devices, for example). In other words, a −100 percent input from the steering device may correspond to a −45 degree steering angle for the marine propulsion device. In typical use, the central control module 28 generally steers the marine propulsion devices to meet these command targets of between −30 and +30 degrees, depending on the steering percentage transmitted from the steering device. However, as discussed above, there are instances in which one or more marine propulsion devices are not being steered. This may result from faults, or due to the marine propulsion device not running.

Figure 3:
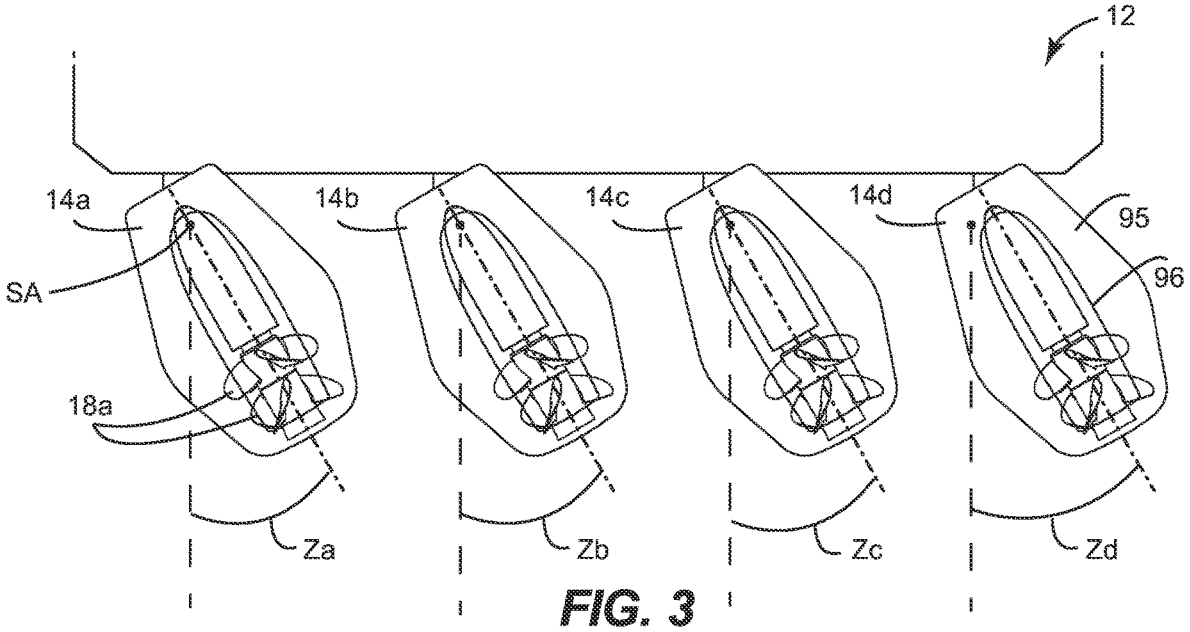
FIG. 3 is a partial top view of a marine vessel having four marine propulsion devices operated according to the present disclosure, particularly with all four marine propulsion devices having the same steering angles.
Figure 4:
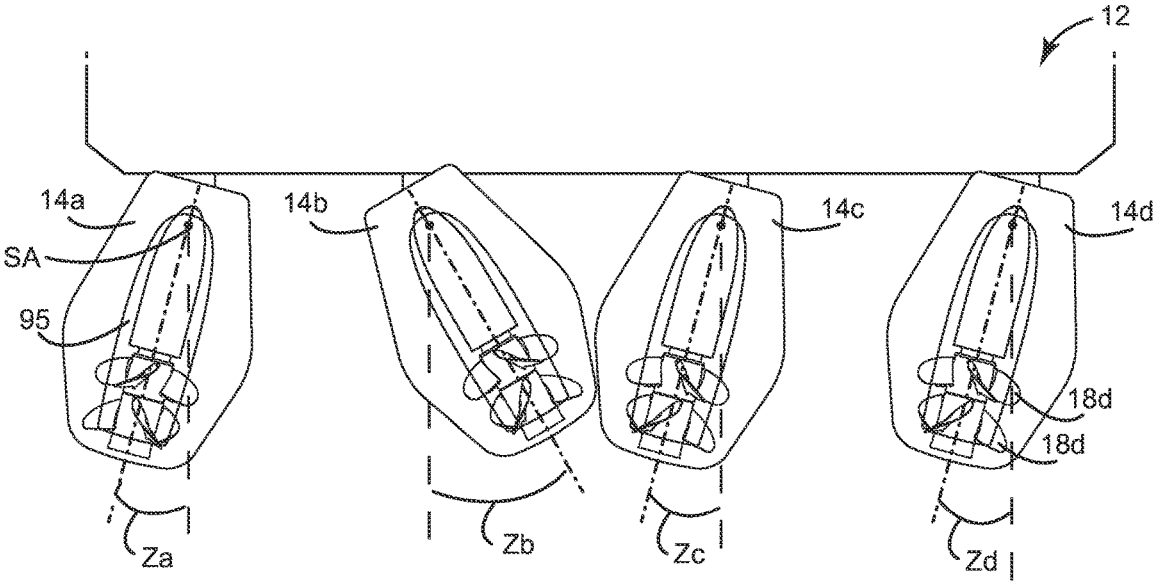
FIG. 4 is a top view of a configuration similar to FIG. 3, but wherein the second marine propulsion device has been deactivated such that the corresponding steering angle does not align with the other marine propulsion devices.

FIG. 3 depicts a view of a marine vessel 12 having four marine propulsion devices 14*a*-14*d* each steerable about a respective steering axis SA, which in the present case are all shown to be positioned at a steering angle Za-Zd corresponding to steering the marine vessel 12 in a starboard direction. In particular, all four of the marine propulsion device 14*a*-14*d* are shown have steering angles Za-Zd of +30 degrees. In a hypothetical example, the second marine propulsion device 14*b* is then deactivated such that it is no longer steerable, for example by the operator keying off the second marine propulsion device 14*b*. As shown in FIG. 4, this results in the second marine propulsion device 14*b* remaining at a fixed steering angle Zb of the same+30 degrees shown above in FIG. 3, despite the other marine propulsion devices 14*a*, 14*c*-14*d* continuing to be steered by the operator as shown steering to port in FIG. 4. As shown in the FIG. 4, the steering angles Za, Zc-Zd of the marine propulsion devices 14*a*, 14*c*-14*d* are now limited or restricted to a predetermined restriction angle (i.e., plus or minus this restriction angle relative to dead ahead) to prevent a collision with the marine propulsion device having deactivated steering. In the present example, when steering for the second marine propulsion device 14*b* is deactivated, this restriction of the steering angles Za, Zc-Zd for the remaining marine propulsion devices 14*a*, 14*c*-14*d* to not exceed the predetermined restriction angles specifically prevents a collision between a second marine propulsion device 14*b* and a third marine propulsion device 14*c*.

In the example of FIG. 4, the predetermined restriction angle for the marine propulsion devices 14*a*, 14*c*-14*d* is ±15 degrees. Therefore, the central control module 28 will restrict steering of these marine propulsion devices 14*a*, 14*c*-14*d* to not exceed steering angles of ±15 degrees even if a steering request greater than this restricted angle is received from one of the steering devices. It will be recognized that these restrictions on the steering angles Za, Zc-Zd may always be limited to a fixed maximum steering angle, such as 15 degrees, or may be variable depending upon the steering angle and/or trim angle of the non-steerable or deactivated marine propulsion device. For example, the limitation on the steering angle Zc of the third marine propulsion device 14*c* may depend upon the steering angle Zb of the second marine propulsion device 14*b*.

Moreover, the steerable marine propulsion devices 14*a*, 14*c*-*d* may be bound by the same limit, for example 15 degrees as discussed above and shown in FIG. 4, or have differing limits depending upon their individual possibilities for collision. For example, in the example shown in FIG. 4, the first marine propulsion device 14*a* and fourth marine propulsion device 14*d* may be permitted to steer at greater steering angles Za, Zd than the third marine propulsion device 14*c* in recognition that the only opportunity for collision is with respect to a second marine propulsion device 14*b*, which is fixed in an angle away from the first marine propulsion device 14*a*.

As discussed above, the present inventors have recognized that issues may then arise when previously deactivated steering for a marine propulsion device is activated and allowed to steer. For example, if the second marine propulsion device 14*b* is restarted after the marine propulsion devices 14*a*-14*d* have been oriented as shown in FIG. 4, a safe and robust method for returning the steering of the second marine propulsion device 14*b* in alignment with the other marine propulsion devices 14*a*, 14*c*-14*d* is lacking in the art. If the second marine propulsion device 14*b* is suddenly permitted to steer in accordance with the remaining marine propulsion devices 14*a*, 14*c*-*d*, the result would be a change from a steering angle Zb shown corresponding to steering the marine vessel 12 towards the starboard direction to an opposite direction of steering toward port (e.g., to mirror the steering angles Za, Zc-Zd of the remaining marine propulsion devices 14*a*, 14*c*-14*d*). As previously discussed, FIG. 4 shows an example where these steering angles Za, Zc-Zd are −15 degrees. It will be recognized that changing the steering angle Zb of the second marine propulsion device 14*b* will then change the direction in which the marine vessel 12 is headed, and notably without any input by the operator. This results in unpredictable behavior by the marine vessel 12, leading to unpleasant and/or unsafe operating conditions.

Moreover, once the second marine propulsion device 14*b* becomes activated and begins to steer towards the steering angle Zb mirroring the steering angles Za, Zc-Zd of the other marine propulsion devices 14*a*, 14*c*-*d*, the previous restrictions imposed on the steering angles Za, Zc-Zd may be removed, specifically because the third marine propulsion device 14*c* is no longer at risk of colliding with the second marine propulsion device 14*b*. Consequently, this could result in further steering changes, again without additional operator input. Specifically, the elimination of the restriction angle could result in a stepped response as the second marine propulsion device 14*b* automatically moving towards alignment with the other marine propulsion devices 14*a* 14*c*-*d*, followed by all marine propulsion device 14*a*-14*d* then adjusting to mirror the previous inputs of the steering wheel once the limitations are lifted from the second marine propulsion device 14*b* moving out of the way. In other words, a first shift may occur for movement of the second marine propulsion device 14*b*, for example from starboard to a steering angle Zb equal to 15 degrees in the port direction, and then all steering angles Za-Zd moving to reflect the original request of the steering wheel, for example to a different value such as 30 degrees port.

A configuration substantially similar to FIG. 4 is shown in FIG. 5, but particularly for a marine vessel 12 outfitted with marine propulsion devices 14*a*-14*d* that have a steerable lower gear case 96 relative to the upper gear case 95. In this example, the upper gear case 95 remains at a fixed angle relative to the marine vessel 12, but the lower gear case 96 is steerable about a steering axis SA relative to the upper gear case 95 to steer the marine propulsion devices 14*a*-14*d*. Moreover, the present inventors have recognized that the problems described above are only further exacerbated by marine propulsion devices having steerable lower gearcases, as this often enables the marine propulsion devices to be installed even closer together than those having steerable upper gearcases as well. An exemplary steerable gearcase is described in U.S. Pat. No. 4,932,907 and U.S. patent application Ser. No. 16/171,490 which are each incorporated herein in their entireties.

In recognition of these issues, the inventors have developed the presently disclosed systems and methods for aligning the steering angles of marine propulsion devices, and particularly when steering for one or more of the marine propulsion devices becomes activated after being out of alignment with the other marine propulsion devices for one reason or another.

Figure 6:
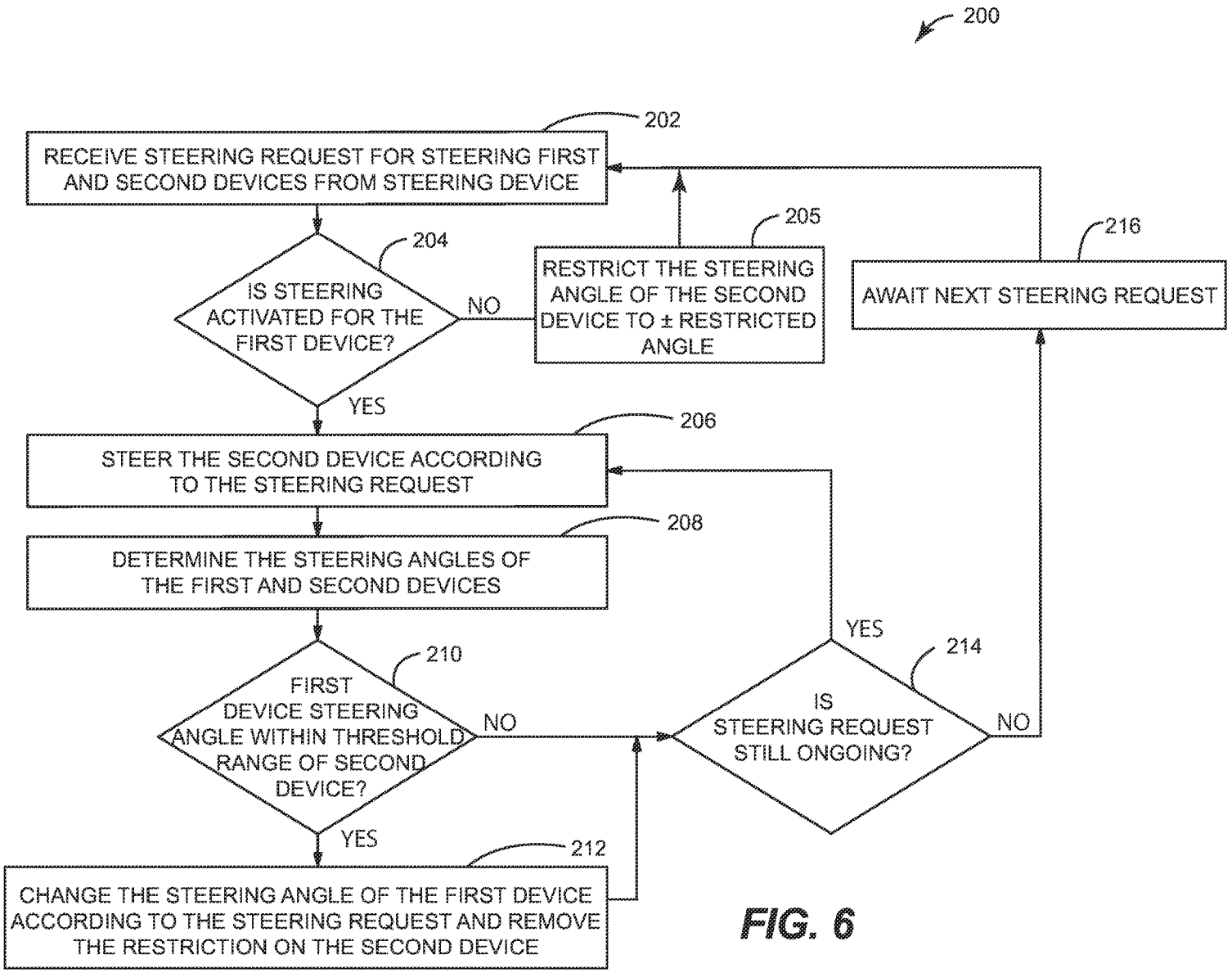
FIG. 6 is an exemplary process flow for aligning the steering angles of marine propulsion devices according to the present disclosure.

An exemplary method 200 is shown in FIG. 6, which begins with receiving a steering request for steering first and second devices for a steering device in step 202, which may be received in a customary manner. In step 204, it is determined whether steering is activated for the first device. If steering for the first device is deactivated, the steering angle of the second device is restricted in step 205 to a restriction angle (e.g. ±15 degrees) to prevent a collision with the first device while the steering of the first device remains deactivated and non-steering. The process then returns to step 202, whereby steering for the marine propulsion devices having activated steering otherwise occurs by methods presently known in the art. As described above, this may include limitations for steering angles of steerable marine propulsion devices based on the steering angle of the marine propulsion device with deactivated steering. If it is determined in step 204 that steering has been reactivated for the first device, steering the second device is still provided according to the steering request in step 206; however, the first device is not steered until further steps are first performed.

In particular, the steering angles of the first and second devices are determined in step 208. Step 210 then provides for determining whether the first device steering angle is within a threshold range of the second device. Specifically, the steering angles of the first and second marine propulsion devices are compared to determine a delta therebetween, which is compared to a threshold range to determine whether the delta is less than or equal to that allowable threshold range. In an exemplary embodiment, the threshold range between the steering angles of the first and second steering angles is 10 degrees. If the first device steering angle is determined to be within the threshold range of the second device steering angle in step 210, the process continues to step 212, whereby any restrictions on the second device are removed and the steering angle of the first device is permitted to change according to the steering request. In other words, the first device is permitted to steer according to the steering request in step 206 once the steering angles of the first and second devices are determined to be within the threshold range of one another. This provides for a smooth and controlled reactivation of steering for the first device, as steering for the first device is not reactivated until the steering angles of the first and second devices are relatively close to each other, specifically within the threshold range predetermined to be allowable.

It will be recognized that the threshold range may be set to values other than 10 degrees as discussed above, such as 30 degrees, 15 degrees, 5 degrees, 1 degree, or other amounts. The threshold range may also vary based on other inputs, such as the speed of the marine vessel 12 (e.g., a larger threshold range at slower speeds). It will further be recognized that these threshold ranges in certain embodiments need not require the marine propulsion device to be adjusted to be on the same side of the dead ahead position as the other marine propulsion devices. For example, in certain embodiments two marine propulsion devices having steering angles of +2 degrees (steering starboard, such as the second steering angle Zb of FIG. 4) and −8 degrees (steering port, such as the first steering angle Za of FIG. 4), respectively, would meet the criteria of being within a 10 degree threshold angle, here being exactly 10 degrees apart.

In other embodiments, in addition to or as an alternative to comparing steering angles to a threshold range as discussed above, both marine propulsion devices must be steering in the same general direction before steering is permitted for a marine propulsion device in which steering was previously deactivated. For example, the second marine propulsion device 14*b* of FIG. 4 (which is presently angled to steer in the starboard direction) may be permitted to steer again only when the remaining marine propulsion devices 14*a*, 14*c*-*d* are angled to also be steering in the starboard direction. In further embodiments, the remaining marine propulsion devices 14*a*, 14*c*-*d* may be directed dead ahead as an alternate to being in the starboard direction to enable steering for the second marine propulsion device 14*b* to steer again.

If instead it is determined in step 210 that the steering angles of the first and second devices are not within the threshold range of one another, it is determined at 214 whether the steering request is still ongoing. If the steering request remains ongoing as determined in step 214, the process returns to step 206 and repeats the analysis. If instead the steering request is no longer determined to be ongoing in step 214, the process continues to step 216, whereby the system awaits the next steering request.

Additional methods for aligning steering angles of marine propulsion devices are also provided herein. In another exemplary method, the process begins by receiving a first steering request from the steering device to steer the marine propulsion devices, whereby when the first steering request is received, steering for a first device among the marine propulsion devices is deactivated and steering for a second device is activated. The process continues with changing the steering angle according to the first steering request for the second device, whereby the steering angle of the first device remains unchanged. Next, a request to activate steering for the first device is received, followed by receiving a second steering request from the steering device to steer the marine propulsion devices. Since the second steering request is received after receiving the request to activate steering for the first device, the steering angles of both the first device and the second device are allowed to change according to the second steering request.

Figure 7:
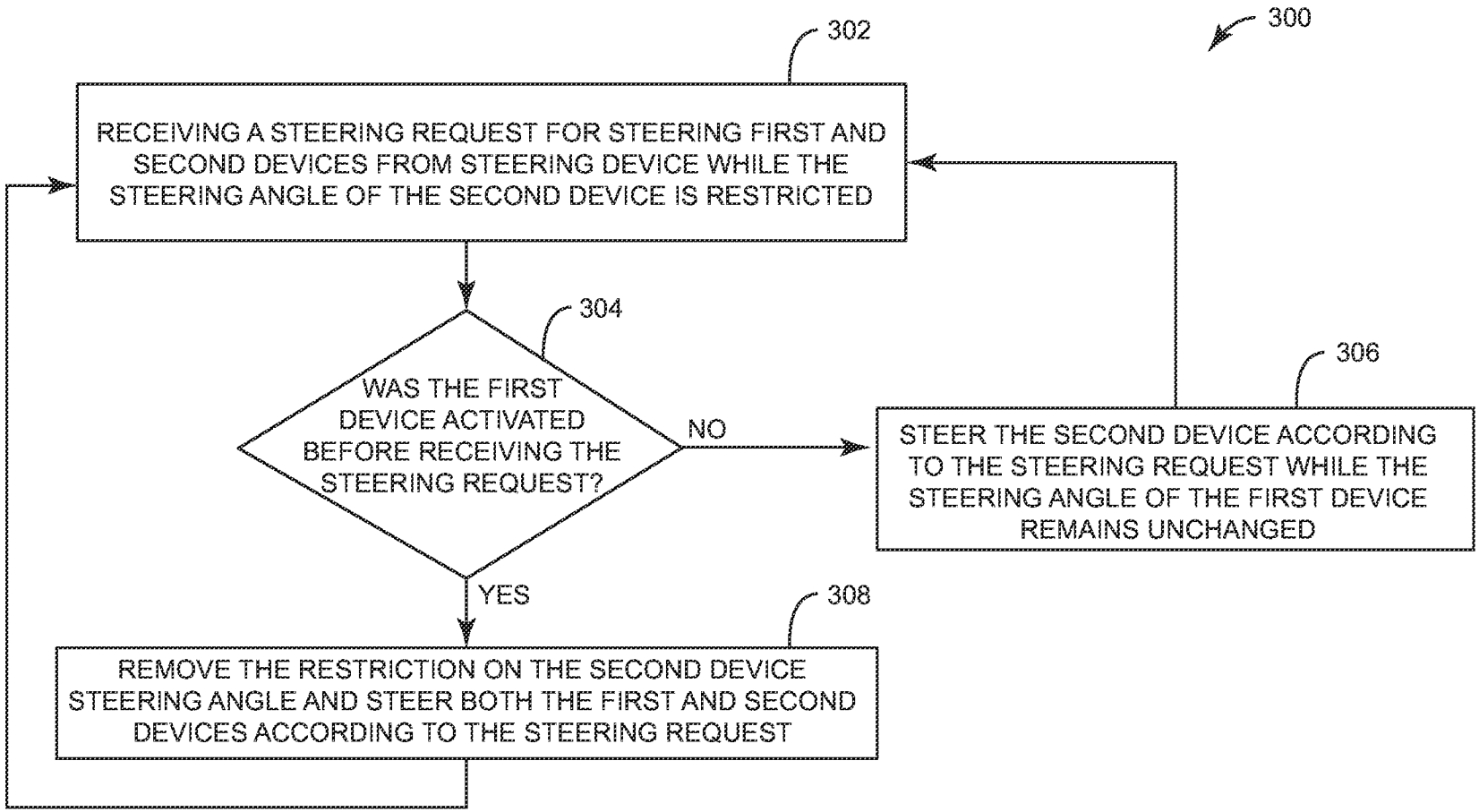
FIG. 7 is another exemplary process flow for aligning the steering angles of marine propulsion devices according to the present disclosure.

It will be recognized that in this method, realignment of the steering angles for marine propulsion devices that have been reactivated is not performed until a new steering request is provided by the user. In other words, no changes occur to the steering of the reactivated marine propulsion device merely upon restarting that marine propulsion device, but instead alignment awaits a further intentional steering action by the user. This ensures that the user is paying attention and intentionally changing the steering direction for the marine vessel before any consequences of reactivating steering for the previously deactivated steering system take effect. This method 300 is generally shown in FIG. 7, whereby a steering request is received in step 302 and it is then determined in step 304 whether the first device (for example) was activated before the steering request was received. If so, the first device can then be steered along with the second device in step 308 according to the steering request. However, if the steering request was received before the first device was activated, step 306 provides for steering the second device according to the steering request, but leaving the steering angle of the first device unchanged, whereby the process continues back at step 302.

In further embodiments, the system is configured such that alignment of the steering angles not only waits until after the steering angle limitations imposed on that marine propulsion device are removed (e.g., previously deactivated steering is activated by keying on the corresponding marine propulsion device), but also after a steering request is received corresponding to a steering that is less than that previous steering limitation. In other words, if a marine propulsion device were previously limited to −10 degrees, that marine propulsion device would not be permitted to change steering angles to −20 degrees, for example, until first steering according to a steering angle that is closer to dead ahead than the −10 degree limit (e.g., a request for −8 degrees). In this example, once the −10 degree limit is removed and the marine propulsion device has adjusted the steering angle to −8 degrees, that marine propulsion device would then be permitted to follow subsequent steering requests for −20 degrees, +20 degrees, or any other permissible steering angle (based on the other marine propulsion devices, for example).

In certain examples, alerts of indications at the helm 32 are provided when the later activated marine propulsion device resumes steering. This may take place as a visual indicator showing the steering angles of each marine propulsion device in real-time. This enables the operator to see when changes are being made to a misaligned marine propulsion device, providing insight as to why the marine vessel may be reacting differently than expected while turning during the realignment.

In further examples, the steering angle of the marine propulsion devices may change at different rates, for example until the steering angles are once again in alignment. For example, if a steering request would normally result in changing the steering angle at a first rate (e.g., 3 degrees per second for marine propulsion devices 14*a*, 14*c-d* of FIG. 4), the steering system 10 according to the present disclosure may change the steering angle at a second rate (also referred to as an adjustment rate) that is different than the first rate for the second marine propulsion device 14*b* of FIG. 4. In some cases, the steering angle of the first device may change at a slower adjustment rate (e.g., 1 degree per second) than the normal rates for changing the steering angles of the other marine propulsion devices such that the effects of correction are more subtle. In other examples, the second rate is faster than the first rate (e.g. 4 or 5 degrees per second) so as to align all marine propulsion devices 14*a-d* quickly.

Moreover, whether the marine propulsion devices steer at different rates or the same rate, the adjustment rate of changing these steering angles may vary according to other factors, such as the speed of the marine vessel 12. For example, the steering angle of a marine propulsion device with previously disabled steering may be permitted to move at a faster adjustment rate when the marine vessel 12 is trolling, and faster still when the marine vessel 12 is stationary.

As with the other limitations and control functions described herein, these may be governed by values in a lookup table stored in memory, for example. Other factors may also be incorporated into the controls for changing steering angles, such as the separation distance of the marine propulsion devices, whether each marine propulsion device has one or two propellers along with the sizes thereof (e.g., the lengths and diameters), trim angles, and/or the velocity of the marine vessel at the time of steering, for example.

As discussed above, in certain examples changing the steering angle of the first device may further wait until the second device is already angled in a same general direction. For example, if the first device was disable while steering in a port direction, the system may prevent the first device from once again steering upon reactivation until the second device is also steering in the port direction, or at least dead ahead, to again prevent any uneven or turbulent response from reactivating steering of the first device. As also discussed above, this may be addition to requiring the respective steering angles being within a threshold range of each other, for example 10 degrees.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A steering system for marine propulsion devices, the system comprising:

a steering device;

steering actuators configured to change steering angles of the marine propulsion devices; and a control system operatively connected to the steering actuators and operatively connected to the steering device to receive steering requests therefrom, the control system being configured to:

receive a request to activate the steering for a first device among the marine propulsion devices; and change the steering angle of the first device according to a steering request when the steering request is received after receiving the request to activate the steering for the first device, and leave the steering angle for the first device unchanged when the steering request is received before receiving the request to activate the steering for the first device.

2. The steering system according to claim 1, wherein the control system is further configured to change the steering angle of a second device among the marine propulsion devices when the steering request is received before receiving the request to activate the steering for the first device.

3. The steering system according to claim 2, wherein the control system is further configured to change the steering angle of the second device at a first rate and to change the steering angle of the first device at a second rate that is different than the first rate until the steering angles of the first and second devices are aligned.

4. The steering system according to claim 3, wherein the first rate is greater than the second rate.

5. The steering system according to claim 1, wherein the marine propulsion devices are configured to propel a marine vessel in a body of water, wherein the control system is further configured to determine a speed of the marine vessel in the body of water and to change the steering angle of the first device at a first rate that varies based on the speed of the marine vessel.

6. The steering system according to claim 5, wherein the first rate increases as the speed of the marine vessel decreases.

7. The steering system according to claim 1, wherein the control system is configured to receive the request to activate the steering for the first device when the first device is started.

8. The steering system according to claim 1, wherein the control system is further configured to indicate to an operator when the steering for the first device resumes after previously being deactivated.

9. The steering system according to claim 1, further comprising a display device, wherein the control system is further configured to display the steering angles of each of the marine propulsion devices via the display device.

10. The steering system according to claim 1, wherein the control system is further configured to restrict the steering angle of a second device among the marine propulsion devices when the steering for the first device is deactivated.

11. The steering system according to claim 10, wherein the steering angle of the second device is restricted to a restriction angle when restricted by the control system, and wherein the control system is further configured to remove the restriction on the steering angle of the second device only when the second steering request corresponds to a steering angle less than or equal to the restriction angle.

12. The steering system according to claim 10, wherein the control system is configured to restrict the steering angle of the second device to ±15 degrees when the steering angle of the second device is restricted.

13. The steering system according to claim 1, wherein the steering angles of the first device and the second device each correspond to steering towards one of port, dead ahead, and starboard, wherein the control system is further configured to, after receiving the request to activate the steering for the first device and subsequently receiving the second steering request, change the steering angle of the first device according to the second steering request only when the first and second devices are steering towards one of port and port, port and dead ahead, dead ahead and port, starboard and starboard, starboard and dead ahead, and dead ahead and starboard, respectively.

14. The steering system according to claim 13, wherein the control system is further configured to, after receiving the request to activate the steering for the first device and subsequently receiving the steering request:

compare the steering angle of the first device to the steering angle of a second device among the marine propulsion devices to determine a delta therebetween;

compare the delta determined between the steering angles of the first and second devices to a threshold range; and change the steering angle of the first device according to the steering request only when the delta between the steering angles of the first device and the second device is determined to be less than or equal to the threshold range.

15. The steering system according to claim 1, wherein the control system is further configured to, after receiving the request to activate the steering for the first device and subsequently receiving the steering request:

compare the steering angle of the first device to a steering angle of a second device among the marine propulsion devices to determine a delta therebetween;

compare the delta determined between the steering angles of the first and second devices to a threshold range; and change the steering angle of the first device according to the steering request only when the delta between the steering angles of the first device and the second device is determined to be less than or equal to the threshold range.

16. The steering system according to claim 15, wherein the threshold range is 10 degrees.

17. The steering system according to claim 15, wherein the marine propulsion devices are configured to propel a marine vessel in a body of water, wherein the control system is further configured to determine a speed of the marine vessel in the body of water, and wherein the threshold range varies based on the speed of the marine vessel.

18. The steering system according to claim 17, wherein the threshold rate increases as the speed of the marine vessel decreases.

19. The steering system according to claim 15, wherein the control system is further configured to restrict the steering angle of the second device when the delta between the steering angles of the first and second devices is determined to exceed the threshold range.

20. A steering system for marine propulsion devices, the system comprising:

a steering device;

steering actuators configured to change steering angles of the marine propulsion devices; and a control system operatively connected to the steering actuators and operatively connected to the steering device to receive steering requests therefrom, the control system being configured to:

determine that steering for a first device among the marine propulsion device is deactivated and restrict the steering angle of a second device among the marine propulsion devices to a restriction angle when the steering for the first device is deactivated;

receive a request to activate the steering for the first device when the first device is started;

receive a steering request;

remove the restriction on the steering angle of the second device only when the second steering request corresponds to a steering angle less than or equal to the restriction angle; and change the steering angles of both the first device and the second device according to the steering request when the steering request is received after receiving the request to activate the steering for the first device, and to change the steering angle of only the second device when the steering request is received before receiving the request to activate the steering for the first device.

* * * * *